US010616704B1

(12) United States Patent
Yu

(10) Patent No.: US 10,616,704 B1
(45) Date of Patent: Apr. 7, 2020

(54) AUDIO PROCESSING METHOD AND AUDIO PROCESSING SYSTEM

(71) Applicant: Realtek Semiconductor Corporation, Hsinchu (TW)

(72) Inventor: Teng-Hsiang Yu, New Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 16/526,031

(22) Filed: Jul. 30, 2019

(30) Foreign Application Priority Data

Mar. 19, 2019 (TW) ..... 108109395 A

(51) Int. Cl.
*H04S 7/00* (2006.01)
*H04R 5/04* (2006.01)

(52) U.S. Cl.
CPC *H04S 7/30* (2013.01); *H04R 5/04* (2013.01)

(58) Field of Classification Search
CPC ..... H04R 29/004; H04R 2205/024; H04R 2420/07; H04R 27/00; H04R 3/02; H04R 5/02; H04R 1/406; H04R 2227/003; H04R 2227/005; H04R 2227/007; H04R 2499/13; H04R 29/008; H04R 3/002; H04R 17/00; H04R 1/021; H04R 1/1083; H04R 1/403; H04R 2201/401; H04R 2217/03; H04R 2400/00; H04R 2410/00; H04R 2410/05; H04R 2410/07; H04R 2430/00; H04R 25/356; H04R 25/505; H04R 3/00; H04R 3/007; H04R 3/12; H04R 5/04; G10L 19/018; G10L 19/0204; G10L 25/78; G10L 21/0364; G10L 25/18; G10L 19/0212; G10L 21/0232; G10L 25/21; G10L 19/008; G10L 19/02; G10L 19/032; G10L 19/24;
(Continued)

(56) References Cited

U.S. PATENT DOCUMENTS 5,671,287 A * 9/1997 Gerzon ..... H04S 5/00 381/1
6,198,035 B1 * 3/2001 Saito ..... G10H 1/186 84/600

(Continued)

FOREIGN PATENT DOCUMENTS

WO 2015035492 A1 3/2015

*Primary Examiner* — Lun-See Lao
(74) *Attorney, Agent, or Firm* — Locke Lord LLP; Tim TingKang Xia, Esq.

(57) ABSTRACT

An audio processing method includes: providing an input audio signal; performing a transformation process to transform the input audio signal from a time domain to a frequency domain; performing a panning process on an amplitude spectrum corresponding to the input audio signal to obtain a panning amplitude signal; performing a first broader process and a second broader process on a phase spectrum corresponding to the input audio signal to obtain a left channel separation phase signal and a right channel separation phase signal; performing a first inverse transformation process on the panning amplitude signal and the left channel separation phase signal and performing a second inverse transformation process on the panning amplitude signal and the right channel separation phase signal to obtain an optimized left channel output audio signal and an optimized right channel output audio signal corresponding to the time domain.

20 Claims, 6 Drawing Sheets

(58) Field of Classification Search
CPC ..... G10L 21/038; G10L 19/002; G10L 2015/088; G10L 2021/02082; G10L 21/00; G10L 21/0208; G10L 25/90; G10L 19/167; G10L 21/0224; G10L 21/0264; G10L 21/0316; G10L 21/034; G10L 25/51; G10L 25/69; G10L 15/22; G10L 15/30; G10L 15/32; G10L 19/005; G10L 19/012; G10L 19/025; G10L 19/03; G10L 19/035; G10L 19/038; G10L 19/22; G10L 2015/223; G10L 2021/0135; G10L 21/02; G10L 21/0272; G10L 21/028; G10L 21/0388; G10L 25/03; G10L 25/54; G10L 13/00; G10L 13/03
USPC ..... 381/1, 17–22, 61, 63, 27; 700/94
See application file for complete search history.

(56) References Cited

U.S. PATENT DOCUMENTS

| | | | | |
|---|---|---|---|---|
| 9,589,571 | B2 * | 3/2017 | Wuebbolt | G10L 19/008 |
| 2010/0169103 | A1 * | 7/2010 | Pulkki | H04S 7/302 704/500 |
| 2015/0036849 | A1 * | 2/2015 | Thompson | H04S 3/02 381/307 |

* cited by examiner

AUDIO PROCESSING METHOD AND AUDIO PROCESSING SYSTEM

RELATED APPLICATIONS

This application claims priority to Taiwan Application Serial Number 108109395, filed Mar. 19, 2019, which is herein incorporated by reference.

BACKGROUND

Field of Invention

The present Invention relates to an audio processing method and an audio processing system. More particularly, the present invention relates to an audio processing method and an audio processing system to allow the output audio signal to become broader and more spatial.

Description of Related Art

When people heard the sound produced by a sound source, the audio signal usually reaches the left and right ear of the person at two different times, thereby generating different volume. People's brains interpret these differences in time and volume, and produce an auditory scene. Stereo is one method for producing the auditory scene, which provides the audio signal to plural speakers through plural independent sound channels. These speakers are arranged in a symmetrical manner, so that the speakers may produce the auditory scene. In general, stereo is achieved by two sound channels.

SUMMARY

The present invention provides an audio processing method and an audio processing system for optimizing the auditory scene of an audio signal.

One aspect of the invention is directed to an audio processing method. The audio processing method includes: providing an input audio signal, in which the input audio signal is a mono audio signal; performing a transformation process on the input audio signal to transform the input audio signal from a time domain to a frequency domain, thereby obtaining an amplitude spectrum and a phase spectrum corresponding to the input audio signal; providing a processing function group, in which the processing function group includes a panning angle curve, a left channel separation curve, and a right channel separation curve; performing a panning process on the amplitude spectrum, thereby obtaining a panning amplitude signal according to the panning angle curve; performing a first broader process on the phase spectrum, thereby obtaining a left channel separation phase signal according to the left channel separation curve; performing a second broader process on the phase spectrum, thereby obtaining a right channel separation phase signal according to the right channel separation curve; performing a first inverse transformation process on the panning amplitude signal and the left channel separation phase signal, thereby obtaining an optimized left channel output audio signal corresponding to the time domain; and performing a second inverse transformation process on the panning amplitude signal and the right channel separation phase signal, thereby obtaining an optimized right channel output audio signal corresponding to the time domain.

In accordance with one or more embodiments of the invention, the panning angle curve is a curve function with a horizontal axis representing a time and a vertical axis representing a panning angle.

In accordance with one or more embodiments of the invention, each of the left channel separation curve and the right channel separation curve is a curve function with a horizontal axis representing a positive spectrum frequency and a vertical axis representing a separation phase angle.

In accordance with one or more embodiments of the invention, the panning process is configured to calculate a panning curve according to the panning angle curve and to multiply the amplitude spectrum by the panning curve, thereby obtaining the panning amplitude signal.

In accordance with one or more embodiments of the invention, the first broader process is configured to add the phase spectrum to the left channel separation curve, thereby obtaining the left channel separation phase signal. The second broader process is configured to add the phase spectrum to the right channel separation curve, thereby obtaining the right channel separation phase signal.

In accordance with one or more embodiments of the invention, the panning process is configured to control a panning angle of each frame of the Input audio signal through the panning angle curve.

In accordance with one or more embodiments of the invention, the first broader process is configured to control a separation phase angle of each of different spectra in the phase spectrum within each frame of the input audio signal through the left channel separation curve. The second broader process is configured to control the separation phase angle of each of different spectra in the phase spectrum within each frame of the input audio signal through the right channel separation curve.

Another aspect of the invention is directed to an audio processing method. The audio processing method includes: providing an Input audio signal, in which the input audio signal includes a left channel audio signal and a right channel audio signal; performing a first transformation process on the left channel audio signal to transform the left channel audio signal from a time domain to a frequency domain, thereby obtaining a left channel amplitude spectrum and a left channel phase spectrum corresponding to the left channel audio signal; performing a second transformation process on the right channel audio signal to transform the right channel audio signal from the time domain to the frequency domain, thereby obtaining a right channel amplitude spectrum and a right channel phase spectrum corresponding to the right channel audio signal; providing a processing function group, in which the processing function group includes a panning angle curve, a left channel separation curve, and a right channel separation curve; performing a first panning process on the left channel amplitude spectrum, thereby obtaining a left channel panning amplitude signal according to the panning angle curve; performing a second panning process on the right channel amplitude spectrum, thereby obtaining a right channel panning amplitude signal according to the panning angle curve; performing a first broader process on the left channel phase spectrum, thereby obtaining a left channel separation phase signal according to the left channel separation curve; performing a second broader process on the right channel phase spectrum, thereby obtaining a right channel separation phase signal according to the right channel separation curve; performing a first inverse transformation process on the left channel panning amplitude signal and the left channel separation phase signal, thereby obtaining an optimized left channel output audio signal corresponding to the time domain; and performing a second inverse transformation process on the right channel panning amplitude signal and the right channel separation phase signal, thereby obtaining an optimized right channel output audio signal corresponding to the time domain.

In accordance with one or more embodiments of the invention, the panning angle curve is a curve function with a horizontal axis representing a time and a vertical axis representing a panning angle.

In accordance with one or more embodiments of the invention, each of the left channel separation curve and the right channel separation curve is a curve function with a horizontal axis representing a positive spectrum frequency and a vertical axis representing a separation phase angle.

In accordance with one or more embodiments of the Invention, the first panning process is configured to calculate a panning curve according to the panning angle curve and to multiply the left channel amplitude spectrum by the panning curve, thereby obtaining the left channel panning amplitude signal. The second panning process is configured to calculate the panning curve and to multiply the right channel amplitude spectrum by the panning curve, thereby obtaining the right channel panning amplitude signal.

In accordance with one or more embodiments of the invention, the first broader process is configured to add the left channel phase spectrum to the left channel separation curve, thereby obtaining the left channel separation phase signal. The second broader process is configured to add the right channel phase spectrum to the right channel separation curve, thereby obtaining the right channel separation phase signal.

In accordance with one or more embodiments of the invention, the first panning process is configured to control a panning angle of each frame of the left channel audio signal through the panning angle curve. The second panning process is configured to control the panning angle of each frame of the right channel audio signal through the panning angle curve.

In accordance with one or more embodiments of the invention, the first broader process is configured to control a separation phase angle of each of different spectra in the phase spectrum within each frame of the left channel audio signal through the left channel separation curve. The second broader process is configured to control the separation phase angle of each of different spectra in the phase spectrum within each frame of the right channel audio signal through the right channel separation curve.

Another aspect of the invention is directed to an audio processing system for processing an input audio signal, in which the input audio signal includes a left channel audio signal and a right channel audio signal. The audio processing system includes: a transformation circuitry, a processing function circuitry, a panning circuitry, a broader circuitry, an inverse transformation circuitry, and an audio signal output circuitry. The transformation circuitry is configured to perform a first transformation process and a second transformation process. The first transformation process is performed on the left channel audio signal to transform the left channel audio signal from a time domain to a frequency domain, thereby obtaining a left channel amplitude spectrum and a left channel phase spectrum corresponding to the left channel audio signal. The second transformation process is performed on the right channel audio signal to transform the right channel audio signal from the time domain to the frequency domain, thereby obtaining a right channel amplitude spectrum and a right channel phase spectrum corresponding to the right channel audio signal. The processing function circuitry is configured to provide a processing function group, in which the processing function group includes a panning angle curve, a left channel separation curve, and a right channel separation curve. The panning circuitry is configured to perform a first panning process and a second panning process. The first panning process is performed on the left channel amplitude spectrum, thereby obtaining a left channel panning amplitude signal according to the panning angle curve. The second panning process is performed on the right channel amplitude spectrum, thereby obtaining a right channel panning amplitude signal according to the panning angle curve. The broader circuitry Is configured to perform a first broader process and a second broader process. The first broader process is performed on the left channel phase spectrum, thereby obtaining a left channel separation phase signal according to the left channel separation curve. The second broader process is performed on the right channel phase spectrum, thereby obtaining a right channel separation phase signal according to the right channel separation curve. The inverse transformation circuitry is configured to perform a first inverse transformation process and a second inverse transformation process. The first inverse transformation process is performed on the left channel panning amplitude signal and the left channel separation phase signal, thereby obtaining an optimized left channel output audio signal corresponding to the time domain. The second inverse transformation process is performed on the right channel panning amplitude signal and the right channel separation phase signal, thereby obtaining an optimized right channel output audio signal corresponding to the time domain. The audio signal output circuitry is configured to output the optimized left channel output audio signal and the optimized right channel output audio signal.

In accordance with one or more embodiments of the invention, the panning angle curve is a curve function with a horizontal axis representing a time and a vertical axis representing a panning angle. Each of the left channel separation curve and the right channel separation curve is a curve function with a horizontal axis representing a positive spectrum frequency and a vertical axis representing a separation phase angle.

In accordance with one or more embodiments of the invention, the first panning process is configured to calculate a panning curve according to the panning angle curve and to multiply the left channel amplitude spectrum by the panning curve, thereby obtaining the left channel panning amplitude signal. The second panning process is configured to calculate the panning curve according to the panning angle curve and to multiply the right channel amplitude spectrum by the panning curve, thereby obtaining the right channel panning amplitude signal.

In accordance with one or more embodiments of the invention, the first broader process is configured to add the left channel phase spectrum to the left channel separation curve, thereby obtaining the left channel separation phase signal. The second broader process is configured to add the right channel phase spectrum to the right channel separation curve, thereby obtaining the right channel separation phase signal.

In accordance with one or more embodiments of the invention, the first panning process is configured to control a panning angle of each frame of the left channel audio signal through the panning angle curve. The second panning process is configured to control the panning angle of each frame of the right channel audio signal through the panning angle curve.

In accordance with one or more embodiments of the invention, the first broader process is configured to control a separation phase angle of each of different spectra in the phase spectrum within each frame of the left channel audio signal through the left channel separation curve. The second broader process is configured to control the separation phase angle of each of different spectra in the phase spectrum within each frame of the right channel audio signal through the right channel separation curve.

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. The using of "first", "second", etc. In the specification should be understood for identify units or data described by the same terminology, but is not referred to particular order or sequence.

Figure 1:
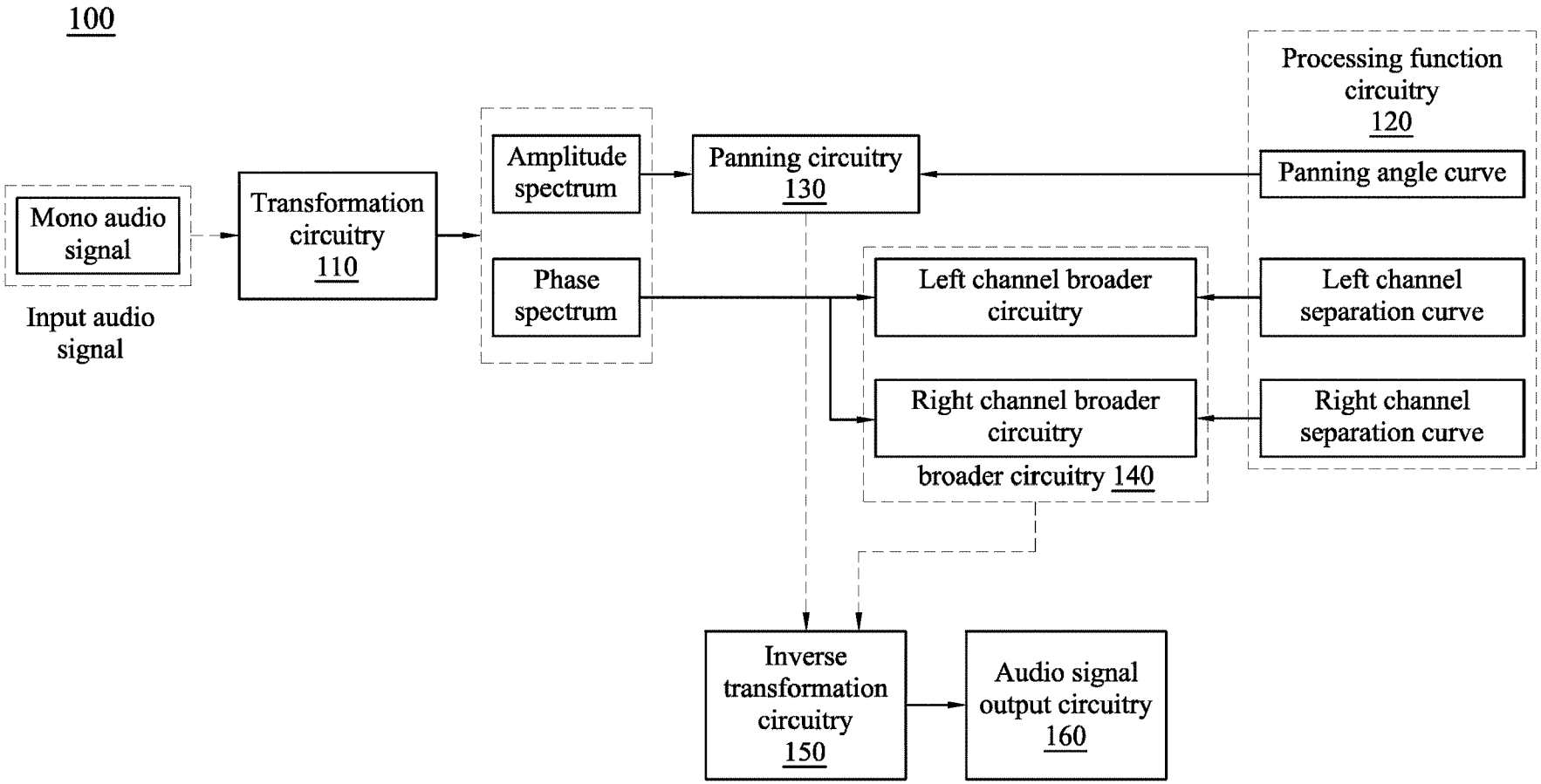
FIG. 1 illustrates a block diagram of an audio processing system according to a first embodiment of the present invention.

FIG. 1 illustrates a block diagram of an audio processing system 100 according to a first embodiment of the present invention. The audio processing system 100 is configured to process an input audio signal from the outside, thereby optimizing its audio effect. This input audio signal is a mono audio signal. The audio processing system 100 includes a transformation circuitry 110, a processing function circuitry 120, a panning circuitry 130, a broader circuitry 140, an inverse transformation circuitry 150, and an audio signal output circuitry 160.

The transformation circuitry 110 of the audio processing system 100 is configured to perform a transformation process on the input audio signal (i.e., the mono audio signal), so as to transform the mono audio signal from a time domain to a frequency domain, thereby obtaining an amplitude spectrum and a phase spectrum corresponding to the mono audio signal. In the first embodiment of the present invention, the transformation circuitry 110 uses Fourier transform to transform the mono audio signal from the time domain to the frequency domain, but the present invention is not limited thereto.

Figure 2A:
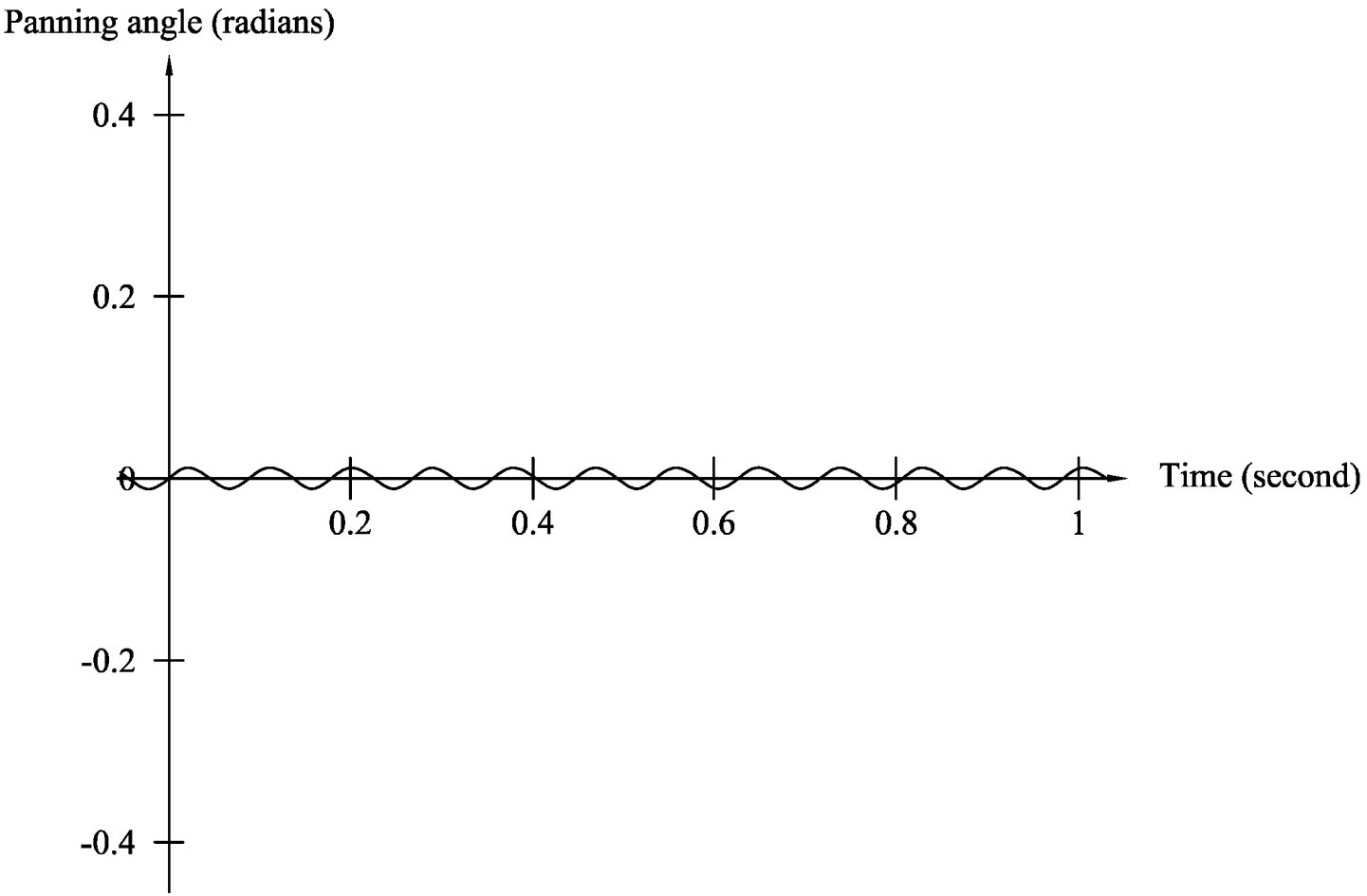
FIG. 2*a* illustrates one of the exemplary panning angle curves according to embodiments of the present invention.
Figure 2B:
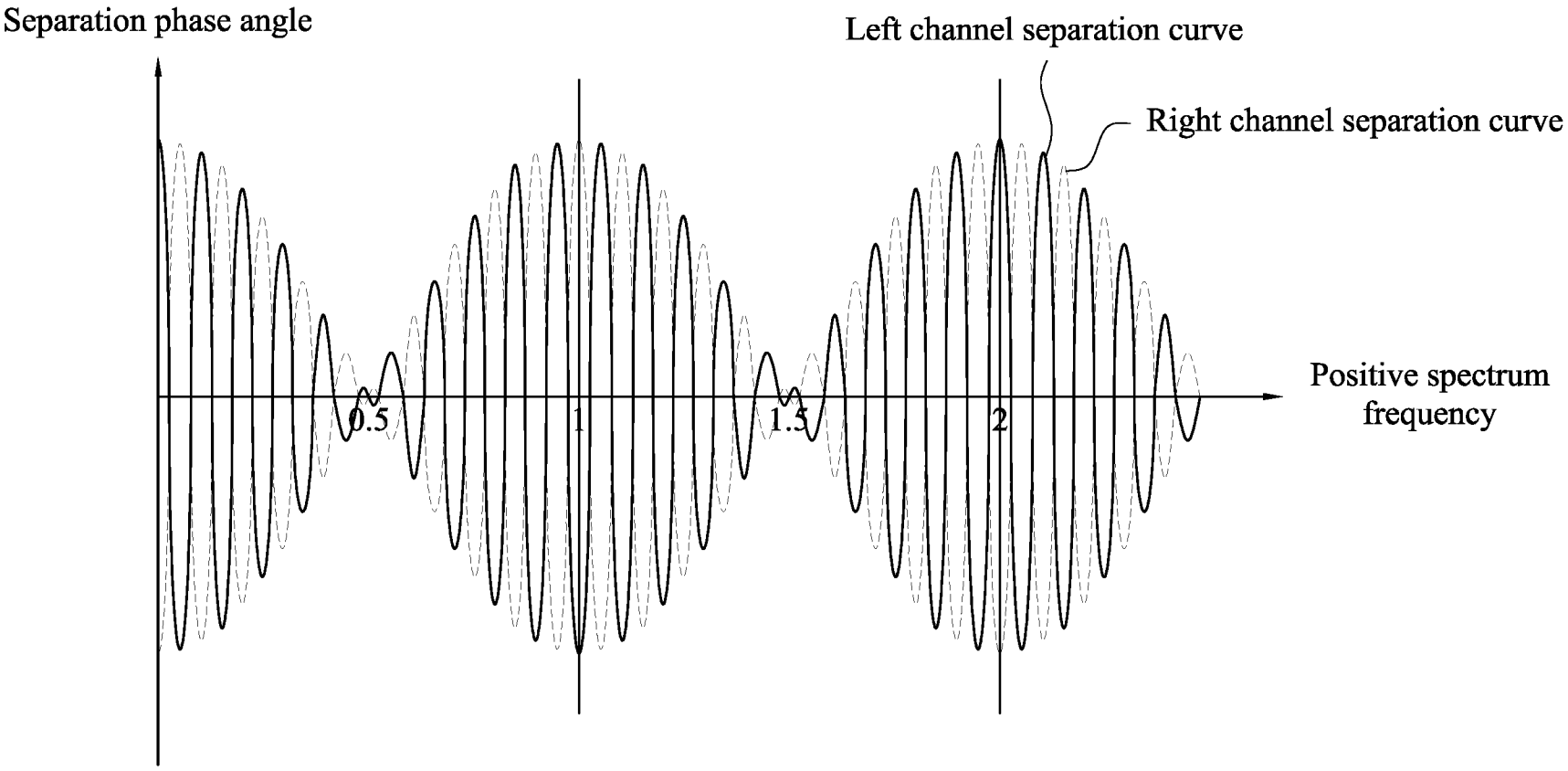
FIG. 2*b* illustrates one of the exemplary left channel separation curves and one of the exemplary right channel separation curves according to embodiments of the present invention.

The processing function circuitry 120 of the audio processing system 100 is configured to provide a processing function group. The processing function group includes a panning angle curve, a left channel separation curve, and a right channel separation curve. FIG. 2*a* illustrates one of the exemplary panning angle curves according to embodiments of the present invention. In the embodiments of the present invention, as shown in FIG. 2*a*, the panning angle curve Is a curve function with a horizontal axis representing a time and a vertical axis representing a panning angle. As shown in FIG. 2*a*, the panning angle represents an angle of the input audio signal in the left and right direction to indicate the directivity of the input audio signal. The panning angle curve illustrated in FIG. 2*a* is a sinusoidal function, and the panning angle curve Illustrated in FIG. 2*a* may be expressed by the following formula:

$$\theta=0.01\times\sin 70t \tag{1}$$

θ represents the panning angle, and its unit is radians. t represents the time, and its unit is second. FIG. 2*b* illustrates one of the exemplary left channel separation curves and one of the exemplary right channel separation curves according to embodiments of the present invention. In the embodiments of the present invention, as shown in FIG. 2*b*, each of the left channel separation curve and the right channel separation curve is a curve function with a horizontal axis representing a positive spectrum frequency and a vertical axis representing a separation phase angle. As shown in FIG. 2*b*, the separation phase angle represents a difference between different phase angles corresponding to the input audio signal at different frequencies. The left channel separation curve illustrated in FIG. 2*b* may be expressed by the following formula:

$$\Delta Ø_L(s)=Ø_\Delta \cos(2\pi f_1 s)\cos(2\pi f_2 s) \tag{2}$$

The right channel separation curve Illustrated in FIG. 2*b* may be expressed by the following formula:

$$\Delta Ø_R(S)=-Ø_\Delta \cos(2\pi f_1 s)\cos(2\pi f_2 s) \tag{3}$$

ΔØ represents the separation phase angle, and its unit Is radians. s represents the positive spectrum frequency, and its unit is hertz (Hz). $Ø_\Delta$ represents the maximum separation phase angle. $f_1$ and $f_2$ are preset frequency values. For example, $f_1$=700 Hz and $f_2$=0.5 Hz. However, the values of $f_1$ and $f_2$ may be adjusted according to the user requirements. It may be seen from the above expressions of the left channel separation curve and the right channel separation curve that phases of the left channel separation curve and the right channel separation curve of embodiments of the present invention are opposite to each other, but the present invention Is not limited thereto. It is noted that, in embodiments of the present invention, the panning angle curve illustrated in FIG. 2*a* and the left channel separation curve and the right channel separation curve illustrated in FIG. 2*b* are only used to exemplarily illustrate one of the Implementation of the present invention. In actual application, for example, the user may select a corresponding panning angle curve, a corresponding left channel separation curve, and a corresponding right channel separation curve according to the form and/or category of the input audio signal.

Regarding FIG. 1, the panning circuitry 130 of the audio processing system 100 is configured to perform a panning process on the amplitude spectrum corresponding to the mono audio signal, thereby obtaining a panning amplitude signal according to the panning angle curve. In the first embodiment of the present invention, the panning process is configured to correspondingly adjust the directivity of the input audio signal. In the first embodiment of the present invention, the panning process is configured to calculate a panning curve according to the panning angle curve and then multiply the amplitude spectrum corresponding to the mono audio signal by the panning curve, thereby obtaining the panning amplitude signal. In the embodiments of the present invention, one of the exemplary panning curves may be expressed by the following formula:

$$P(\theta) = \frac{\sqrt{2}}{2}(\cos\theta - \sin\theta) \tag{4}$$

θ represents the aforementioned panning angle.

In the first embodiment of the present invention, the panning process is configured to control a panning angle of each frame of the mono audio signal through the panning angle curve. In other words, the panning process performed by the panning circuitry 130 of the audio processing system 100 may cause the enunciation position of an output audio signal to be changed, thereby enhancing the position sensing of the output audio signal. It is worth mentioning that the first embodiment of the present invention may control the panning angle of each frame of the input audio signal through the panning angle curve, so that a corresponding output audio signal may be smoothly switched at the left channel and the right channel when the panning angle curve is a continuous curve function.

The broader circuitry 140 of the audio processing system 100 includes a left channel broader circuitry and a right channel broader circuitry. The left channel broader circuitry is configured to perform a first broader process on the phase spectrum, thereby obtaining a left channel separation phase signal according to the left channel separation curve. The right channel broader circuitry is configured to perform a second broader process on the phase spectrum, thereby obtaining a right channel separation phase signal according to the right channel separation curve. In the first embodiment of the present invention, the first broader process is configured to add the phase spectrum to the left channel separation curve, thereby obtaining the left channel separation phase signal. In the first embodiment of the present invention, the second broader process is configured to add the phase spectrum to the right channel separation curve, thereby obtaining the right channel separation phase signal.

In the first embodiment of the present invention, the first broader process is configured to correspondingly adjust the broad level of the left channel audio signal. In the first embodiment of the present Invention, the second broader process is configured to correspondingly adjust the broad level of the right channel audio signal. In the first embodiment of the present invention, the first broader process is configured to control a separation phase angle of each of different spectra in the phase spectrum within each frame of the input audio signal through the left channel separation curve. In the first embodiment of the present invention, the second broader process is configured to control the separation phase angle of each of different spectra in the phase spectrum within each frame of the input audio signal through the right channel separation curve. In other words, the first broader process and the second broader process performed by the broader circuitry 140 of the audio processing system 100 may cause the output audio signal to be more stereoscopic, thereby allowing the output audio signal to become more spatial.

The inverse transformation circuitry 150 of the audio processing system 100 is configured to perform a first inverse transformation process and a second inverse transformation process. The first inverse transformation process is performed on the panning amplitude signal and the left channel separation phase signal, thereby obtaining an optimized left channel output audio signal corresponding to the time domain. The second inverse transformation process is performed on the panning amplitude signal and the right channel separation phase signal, thereby obtaining an optimized right channel output audio signal corresponding to the time domain. In the first embodiment of the present invention, each of the aforementioned first inverse transformation process and the aforementioned second inverse transformation process is inverse-Fourier transform, but the present invention is not limited thereto.

The audio signal output circuitry 160 of the audio processing system 100 is configured to output the optimized left channel output audio signal and the optimized right channel output audio signal. In the first embodiment of the present invention, the audio signal output circuitry 160 is sound card, but the present invention is not limited thereto.

It may be seen from the first embodiment of the present invention that the audio processing system 100 is configured to process the mono audio signal, thereby converting the mono audio signal into a stereo audio signal. Further, the audio processing system 100 creates the sound level change of the left channel and the right channel through the panning angle curve, so as to cause the enunciation position of the output audio signal to be changed, thereby enhancing the position sensing of the input audio signal. The audio processing system 100 further creates the phase delay of the left channel and the right channel through the left channel separation curve and the right channel separation curve, so as to cause the output audio signal to be more stereoscopic, thereby allowing the output audio signal to become more spatial. Specifically, the audio processing system 100 may convert the mono audio signal into the stereo audio signal, and may make the stereo audio effect and the broad effect of the stereo audio signal to be more obvious.

Figure 3:
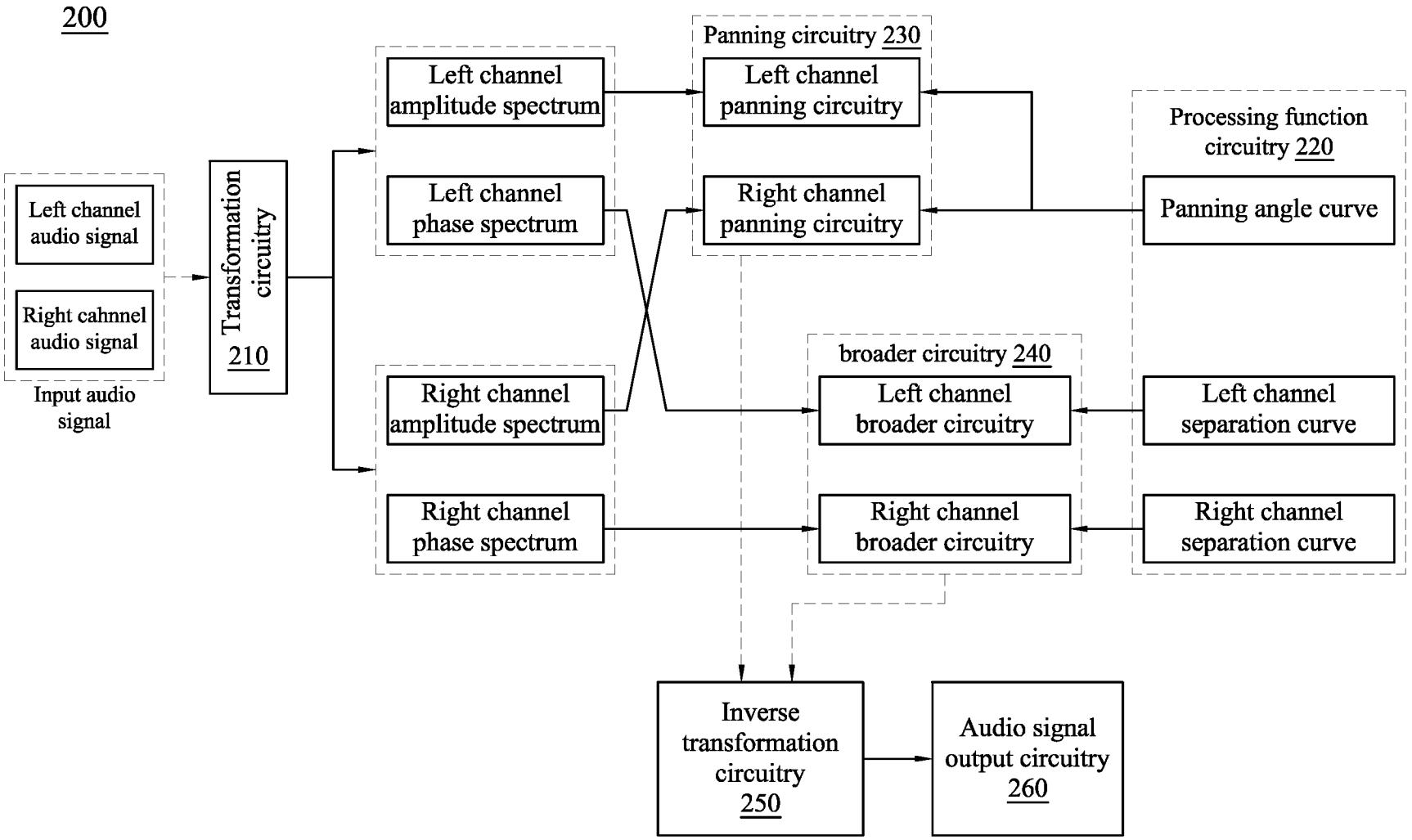
FIG. 3 illustrates a block diagram of an audio processing system according to a second embodiment of the present invention.

FIG. 3 illustrates a block diagram of an audio processing system 200 according to a second embodiment of the present invention. The audio processing system 200 is configured to process an input audio signal from the outside, thereby optimizing its audio effect. This Input audio signal includes a left channel audio signal and a right channel audio signal. The audio processing system 200 includes a transformation circuitry 210, a processing function circuitry 220, a panning circuitry 230, a broader circuitry 240, an inverse transformation circuitry 250, and an audio signal output circuitry 260.

The transformation circuitry 210 of the audio processing system 200 is configured to perform a first transformation process and a second transformation process. The first transformation process is performed on the left channel audio signal to transform the left channel audio signal from the time domain to the frequency domain, thereby obtaining a left channel amplitude spectrum and a left channel phase spectrum corresponding to the left channel audio signal. The second transformation process is performed on the right channel audio signal to transform the right channel audio signal from the time domain to the frequency domain, thereby obtaining a right channel amplitude spectrum and a right channel phase spectrum corresponding to the right channel audio signal. In the second embodiment of the present invention, each of the aforementioned first transformation process and the aforementioned second transformation process is Fourier transform, but the present invention is not limited thereto.

The processing function circuitry 220 of the audio processing system 200 is configured to provide the processing function group. The processing function group includes the panning angle curve (e.g., the panning angle curve as shown in FIG. 2*a*), a left channel separation curve (e.g., the left channel separation curve as shown in FIG. 2*b*), and a right channel separation curve (e.g., the right channel separation curve as shown in FIG. 2*b*).

The panning circuitry 230 of the audio processing system 200 includes a left channel panning circuitry and a right channel panning circuitry. The left channel panning circuitry is configured to perform a first panning process on the left channel amplitude spectrum, thereby obtaining a left channel panning amplitude signal according to the panning angle curve. The right channel panning circuitry is configured to perform a second panning process on the right channel amplitude spectrum, thereby obtaining a right channel panning amplitude signal according to the panning angle curve. In the second embodiment of the present invention, the first panning process is configured to calculate a panning curve according to the panning angle curve and then multiply the left channel amplitude spectrum corresponding to the left channel audio signal by the panning curve, thereby obtaining the left channel panning amplitude signal. In the second embodiment of the present invention, the second panning process is configured to calculate the panning curve according to the panning angle curve and then multiply the right channel amplitude spectrum corresponding to the right channel audio signal by the panning curve, thereby obtaining the right channel panning amplitude signal.

In the second embodiment of the present invention, the first panning process is configured to control a panning angle of each frame of the left channel audio signal through the panning angle curve, and the second panning process is configured to control a panning angle of each frame of the right channel audio signal through the panning angle curve. In other words, the first panning process and the second panning process performed by the panning circuitry 230 of the audio processing system 200 may cause the enunciation position of an output audio signal to be changed, thereby enhancing the position sensing of the output audio signal. It is worth mentioning that the second embodiment of the present invention may control the panning angle of each frame of the input audio signal through the panning angle curve, so that a corresponding output audio signal may be smoothly switched at the left channel and the right channel when the panning angle curve is a continuous curve function.

The broader circuitry 240 of the audio processing system 200 includes a left channel broader circuitry and a right channel broader circuitry. The left channel broader circuitry is configured to perform a first broader process on the phase spectrum, thereby obtaining a left channel separation phase signal according to the left channel separation curve. The right channel broader circuitry is configured to perform a second broader process on the phase spectrum, thereby obtaining a right channel separation phase signal according to the right channel separation curve. In the second embodiment of the present invention, the first broader process is configured to add the left channel phase spectrum to the left channel separation curve, thereby obtaining the left channel separation phase signal. In the second embodiment of the present invention, the second broader process is configured to add the right channel phase spectrum to the right channel separation curve, thereby obtaining the right channel separation phase signal.

In the second embodiment of the present invention, the first broader process is configured to control a separation phase angle of each of different spectra in the phase spectrum within each frame of the input audio signal through the left channel separation curve. In the second embodiment of the present invention, the second broader process is configured to control the separation phase angle of each of different spectra in the phase spectrum within each frame of the input audio signal through the right channel separation curve. In other words, the first broader process and the second broader process performed by the broader circuitry 240 of the audio processing system 200 may cause the output audio signal to be more stereoscopic, thereby allowing the output audio signal to become more spatial.

The inverse transformation circuitry 250 of the audio processing system 200 is configured to perform a first Inverse transformation process and a second inverse transformation process. The first inverse transformation process is performed on the left channel panning amplitude signal and the left channel separation phase signal, thereby obtaining an optimized left channel output audio signal corresponding to the time domain. The second inverse transformation process is performed on the right channel panning amplitude signal and the right channel separation phase signal, thereby obtaining an optimized right channel output audio signal corresponding to the time domain. In the second embodiment of the present invention, each of the aforementioned first inverse transformation process and the aforementioned second inverse transformation process is inverse-Fourier transform, but the present invention is not limited thereto.

The audio signal output circuitry 260 of the audio processing system 200 is configured to output the optimized left channel output audio signal and the optimized right channel output audio signal. In the second embodiment of the present invention, the audio signal output circuitry 260 is sound card, but the present invention Is not limited thereto.

It may be seen from the second embodiment of the present invention that the audio processing system 200 is configured to process a stereo audio signal. Further, the audio processing system 200 creates the sound level change of the left channel and the right channel through the panning angle curve, so as to cause the enunciation position of the output audio signal to be changed, thereby enhancing the position sensing of the output audio signal. The audio processing system 100 further creates the phase delay of the left channel and the right channel through the left channel separation curve and the right channel separation curve, so as to cause the output audio signal to be more stereoscopic, thereby allowing the output audio signal to become more spatial. Specifically, the audio processing system 100 may convert the mono audio signal into the stereo audio signal, and may make the stereo audio effect and the broad effect of the stereo audio signal to be more obvious.

Figure 4:
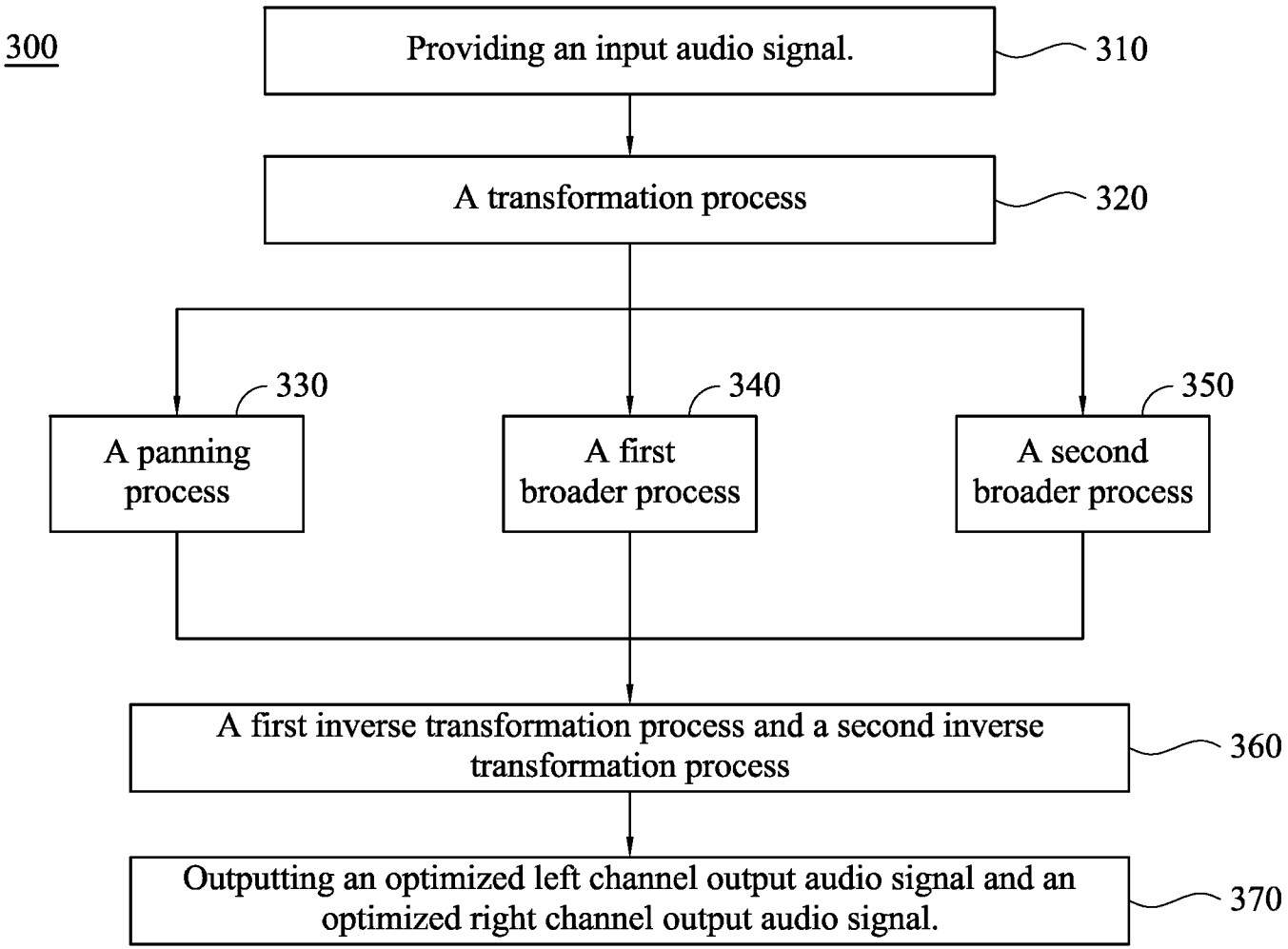
FIG. 4 illustrates a flow chart of an audio processing method corresponding to the audio processing system according to the first embodiment of the present invention.

FIG. 4 illustrates a flow chart of an audio processing method 300 corresponding to the audio processing system 100 according to the first embodiment of the present invention. Regarding the audio processing method 300, the step 310 is first performed to provide the Input audio signal (i.e., the mono audio signal). Then, in step 320, the transformation circuitry 110 of the audio processing system 100 is configured to perform the aforementioned transformation process of the first embodiment of the present invention, thereby transforming the input audio signal from the time domain to the frequency domain. Then, in step 330, the panning circuitry 130 of the audio processing system 100 is configured to perform the aforementioned panning process of the first embodiment of the present invention, thereby obtaining the panning amplitude signal according to the panning angle. Then, in step 340, the broader circuitry 140 of the audio processing system 100 is configured to perform the aforementioned first broader process of the first embodiment of the present invention, thereby obtaining the left channel separation phase signal according to the left channel separation curve. Then, in step 350, the broader circuitry 140 of the audio processing system 100 is configured to perform the aforementioned second broader process of the first embodiment of the present invention, thereby obtaining the right channel separation phase signal according to the right channel separation curve. Then, in step 360, the Inverse transformation circuitry 150 of the audio processing system 100 is configured to perform the aforementioned first inverse transformation process and the aforementioned second inverse transformation process of the first embodiment of the present invention, thereby obtaining the optimized left channel output audio signal and the optimized right channel output audio signal corresponding to the time domain. Then, in step 370, the audio signal output circuitry 160 of the audio processing system 100 is configured to output the optimized left channel output audio signal and the optimized right channel output audio signal.

Figure 5:
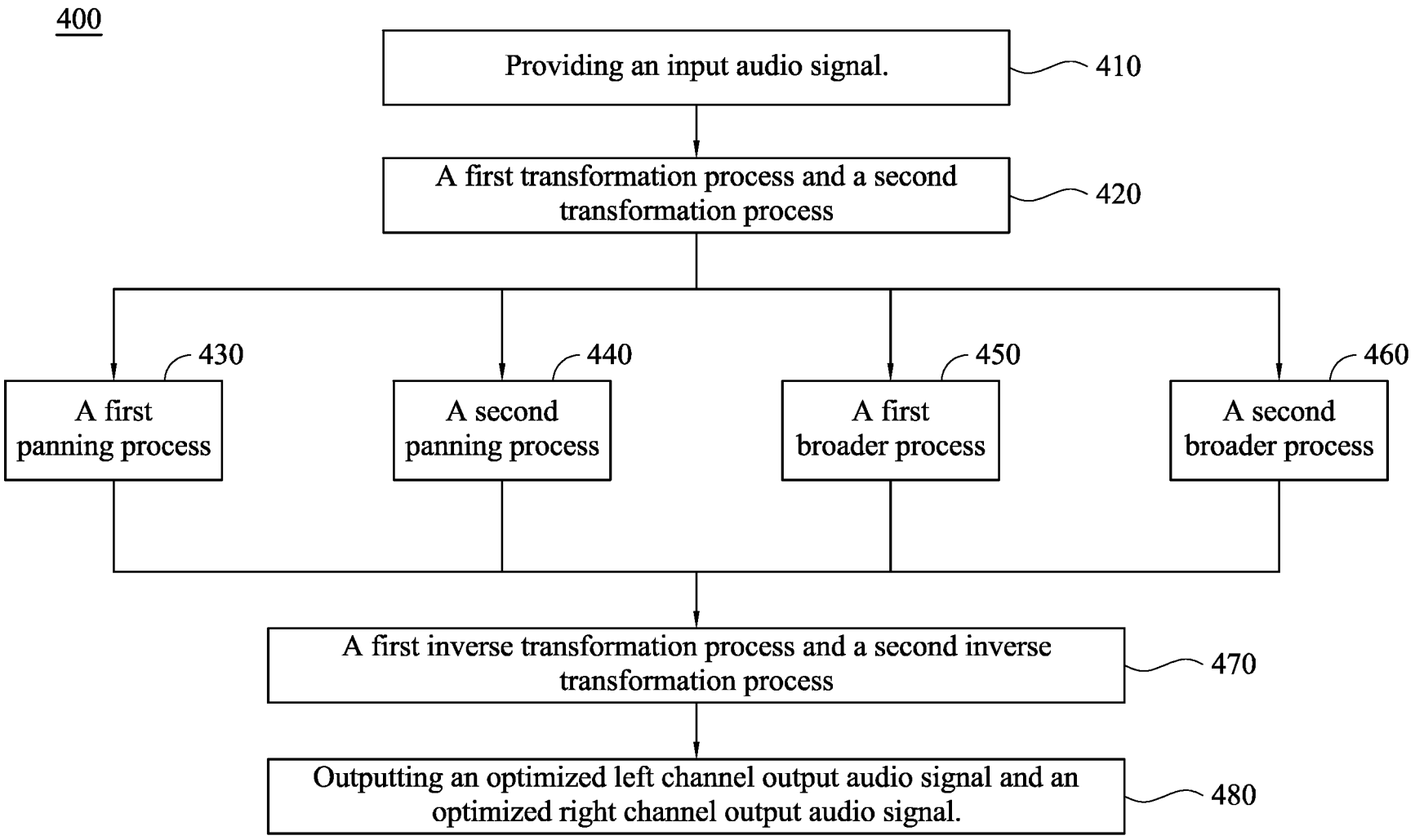
FIG. 5 illustrates a flow chart of an audio processing method corresponding to the audio processing system according to the second embodiment of the present invention.

FIG. 5 illustrates a flow chart of an audio processing method 400 corresponding to the audio processing system 200 according to the second embodiment of the present invention. Regarding the audio processing method 400, the step 410 is first performed to provide the input audio signal (i.e., the left channel audio signal and the right channel audio signal). Then, in step 420, the transformation circuitry 210 of the audio processing system 200 is configured to perform the aforementioned first transformation process of the second embodiment of the present invention, thereby transforming the left channel audio signal from the time domain to the frequency domain, and the transformation circuitry 210 of the audio processing system 200 is further configured to perform the aforementioned second transformation process of the second embodiment of the present invention, thereby transforming the right channel audio signal from the time domain to the frequency domain. Then, in step 430, the panning circuitry 230 of the audio processing system 200 is configured to perform the aforementioned first panning process of the second embodiment of the present invention, thereby obtaining the left channel panning amplitude signal according to the panning angle. Then, in step 440, the panning circuitry 230 of the audio processing system 200 is configured to perform the aforementioned second panning process of the second embodiment of the present invention, thereby obtaining the right channel panning amplitude signal according to the panning angle. Then, in step 450, the broader circuitry 240 of the audio processing system 200 is configured to perform the aforementioned first broader process of the second embodiment of the present invention, thereby obtaining the left channel separation phase signal according to the left channel separation curve. Then, in step 460, the broader circuitry 240 of the audio processing system 200 is configured to perform the aforementioned second broader process of the second embodiment of the present invention, thereby obtaining the right channel separation phase signal according to the right channel separation curve. Then, in step 470, the inverse transformation circuitry 250 of the audio processing system 200 is configured to perform the aforementioned first inverse transformation process and the aforementioned second inverse transformation process of the second embodiment of the present invention, thereby obtaining the optimized left channel output audio signal and the optimized right channel output audio signal corresponding to the time domain. Then, in step 480, the audio signal output circuitry 260 of the audio processing system 200 is configured to output the optimized left channel output audio signal and the optimized right channel output audio signal.

It is noted that, various Implementations of the audio processing systems and the audio processing methods described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or Interpretable on a programmable system including at least one programmable processor, which can be special or general purpose, coupled to receive data and instructions from, and to transmit data and instructions to, a storage system, at least one input device, and at least one output device.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An audio processing method, comprising:

providing an input audio signal, wherein the input audio signal Is a mono audio signal;

performing a transformation process on the Input audio signal to transform the input audio signal from a time domain to a frequency domain, thereby obtaining an amplitude spectrum and a phase spectrum corresponding to the Input audio signal;

providing a processing function group, wherein the processing function group comprises a panning angle curve, a left channel separation curve, and a right channel separation curve;

performing a panning process on the amplitude spectrum, thereby obtaining a panning amplitude signal according to the panning angle curve;

performing a first broader process on the phase spectrum, thereby obtaining a left channel separation phase signal according to the left channel separation curve;

performing a second broader process on the phase spectrum, thereby obtaining a right channel separation phase signal according to the right channel separation curve;

performing a first inverse transformation process on the panning amplitude signal and the left channel separation phase signal, thereby obtaining an optimized left channel output audio signal corresponding to the time domain; and performing a second inverse transformation process on the panning amplitude signal and the right channel separation phase signal, thereby obtaining an optimized right channel output audio signal corresponding to the time domain.

2. The audio processing method of claim 1, wherein the panning angle curve is a curve function with a horizontal axis representing a time and a vertical axis representing a panning angle.

3. The audio processing method of claim 1, wherein each of the left channel separation curve and the right channel separation curve is a curve function with a horizontal axis representing a positive spectrum frequency and a vertical axis representing a separation phase angle.

4. The audio processing method of claim 1, wherein the panning process is configured to calculate a panning curve according to the panning angle curve and to multiply the amplitude spectrum by the panning curve, thereby obtaining the panning amplitude signal.

5. The audio processing method of claim 1, wherein the first broader process is configured to add the phase spectrum to the left channel separation curve, thereby obtaining the left channel separation phase signal;

wherein the second broader process is configured to add the phase spectrum to the right channel separation curve, thereby obtaining the right channel separation phase signal.

6. The audio processing method of claim 1, wherein the panning process is configured to control a panning angle of each frame of the input audio signal through the panning angle curve.

7. The audio processing method of claim 1, wherein the first broader process is configured to control a separation phase angle of each of different spectra in the phase spectrum within each frame of the input audio signal through the left channel separation curve;

wherein the second broader process is configured to control the separation phase angle of each of different spectra in the phase spectrum within each frame of the input audio signal through the right channel separation curve.

8. An audio processing method, comprising:

providing an input audio signal, wherein the input audio signal comprises a left channel audio signal and a right channel audio signal;

performing a first transformation process on the left channel audio signal to transform the left channel audio signal from a time domain to a frequency domain, thereby obtaining a left channel amplitude spectrum and a left channel phase spectrum corresponding to the left channel audio signal;

performing a second transformation process on the right channel audio signal to transform the right channel audio signal from the time domain to the frequency domain, thereby obtaining a right channel amplitude spectrum and a right channel phase spectrum corresponding to the right channel audio signal;

providing a processing function group, wherein the processing function group comprises a panning angle curve, a left channel separation curve, and a right channel separation curve;

performing a first panning process on the left channel amplitude spectrum, thereby obtaining a left channel panning amplitude signal according to the panning angle curve;

performing a second panning process on the right channel amplitude spectrum, thereby obtaining a right channel panning amplitude signal according to the panning angle curve;

performing a first broader process on the left channel phase spectrum, thereby obtaining a left channel separation phase signal according to the left channel separation curve;

performing a second broader process on the right channel phase spectrum, thereby obtaining a right channel separation phase signal according to the right channel separation curve;

performing a first inverse transformation process on the left channel panning amplitude signal and the left channel separation phase signal, thereby obtaining an optimized left channel output audio signal corresponding to the time domain; and performing a second inverse transformation process on the right channel panning amplitude signal and the right channel separation phase signal, thereby obtaining an optimized right channel output audio signal corresponding to the time domain.

9. The audio processing method of claim 8, wherein the panning angle curve is a curve function with a horizontal axis representing a time and a vertical axis representing a panning angle.

10. The audio processing method of claim 8, wherein each of the left channel separation curve and the right channel separation curve is a curve function with a horizontal axis representing a positive spectrum frequency and a vertical axis representing a separation phase angle.

11. The audio processing method of claim 8, wherein the first panning process is configured to calculate a panning curve according to the panning angle curve and to multiply the left channel amplitude spectrum by the panning curve, thereby obtaining the left channel panning amplitude signal;

wherein the second panning process is configured to calculate the panning curve according to the panning angle curve and to multiply the right channel amplitude spectrum by the panning curve, thereby obtaining the right channel panning amplitude signal.

12. The audio processing method of claim 8, wherein the first broader process is configured to add the left channel phase spectrum to the left channel separation curve, thereby obtaining the left channel separation phase signal;

wherein the second broader process is configured to add the right channel phase spectrum to the right channel separation curve, thereby obtaining the right channel separation phase signal.

13. The audio processing method of claim 8, wherein the first panning process is configured to control a panning angle of each frame of the left channel audio signal through the panning angle curve;

wherein the second panning process is configured to control the panning angle of each frame of the right channel audio signal through the panning angle curve.

14. The audio processing method of claim 8, wherein the first broader process is configured to control a separation phase angle of each of different spectra in the phase spectrum within each frame of the left channel audio signal through the left channel separation curve;

wherein the second broader process is configured to control the separation phase angle of each of different spectra in the phase spectrum within each frame of the right channel audio signal through the right channel separation curve.

15. An audio processing system for processing an input audio signal, wherein the input audio signal comprises a left channel audio signal and a right channel audio signal, wherein the audio processing system comprises:

a transformation circuitry configured to perform a first transformation process and a second transformation process, wherein the first transformation process is performed on the left channel audio signal to transform the left channel audio signal from a time domain to a frequency domain, thereby obtaining a left channel amplitude spectrum and a left channel phase spectrum corresponding to the left channel audio signal, wherein the second transformation process is performed on the right channel audio signal to transform the right channel audio signal from the time domain to the frequency domain, thereby obtaining a right channel amplitude spectrum and a right channel phase spectrum corresponding to the right channel audio signal;

a processing function circuitry configured to provide a processing function group, wherein the processing function group comprises a panning angle curve, a left channel separation curve, and a right channel separation curve;

a panning circuitry configured to perform a first panning process and a second panning process, wherein the first panning process is performed on the left channel amplitude spectrum, thereby obtaining a left channel panning amplitude signal according to the panning angle curve, wherein the second panning process is performed on the right channel amplitude spectrum, thereby obtaining a right channel panning amplitude signal according to the panning angle curve;

a broader circuitry configured to perform a first broader process and a second broader process, wherein the first broader process Is performed on the left channel phase spectrum, thereby obtaining a left channel separation phase signal according to the left channel separation curve, wherein the second broader process is performed on the right channel phase spectrum, thereby obtaining a right channel separation phase signal according to the right channel separation curve;

an inverse transformation circuitry configured to perform a first inverse transformation process and a second inverse transformation process, wherein the first inverse transformation process is performed on the left channel panning amplitude signal and the left channel separation phase signal, thereby obtaining an optimized left channel output audio signal corresponding to the time domain, wherein the second Inverse transformation process is performed on the right channel panning amplitude signal and the right channel separation phase signal, thereby obtaining an optimized right channel output audio signal corresponding to the time domain; and an audio signal output circuitry configured to output the optimized left channel output audio signal and the optimized right channel output audio signal.

16. The audio processing system of claim 15, wherein the panning angle curve is a curve function with a horizontal axis representing a time and a vertical axis representing a panning angle;

wherein each of the left channel separation curve and the right channel separation curve is a curve function with a horizontal axis representing a positive spectrum frequency and a vertical axis representing a separation phase angle.

17. The audio processing system of claim 15, wherein the first panning process is configured to calculate a panning curve according to the panning angle curve and to multiply the left channel amplitude spectrum by the panning curve, thereby obtaining the left channel panning amplitude signal;

wherein the second panning process is configured to calculate the panning curve according to the panning angle curve and to multiply the right channel amplitude spectrum by the panning curve, thereby obtaining the right channel panning amplitude signal.

18. The audio processing system of claim 15, wherein the first broader process is configured to add the left channel phase spectrum to the left channel separation curve, thereby obtaining the left channel separation phase signal;

wherein the second broader process is configured to add the right channel phase spectrum to the right channel separation curve, thereby obtaining the right channel separation phase signal.

19. The audio processing system of claim 15, wherein the first panning process is configured to control a panning angle of each frame of the left channel audio signal through the panning angle curve;

wherein the second panning process is configured to control the panning angle of each frame of the right channel audio signal through the panning angle curve.

20. The audio processing system of claim 15, wherein the first broader process is configured to control a separation phase angle of each of different spectra in the phase spectrum within each frame of the left channel audio signal through the left channel separation curve;

wherein the second broader process is configured to control the separation phase angle of each of different spectra in the phase spectrum within each frame of the right channel audio signal through the right channel separation curve.

* * * * *